US005979610A

United States Patent [19]

Hooghiem

[11] Patent Number: 5,979,610

[45] Date of Patent: Nov. 9, 1999

[54] RAIL BRAKE DEVICE HAVING PERMANENT MAGNETIC ENERGIZATION

[75] Inventor: Jelle Hooghiem, Zoetermeer, Netherlands

[73] Assignee: Sab Wabco B.V., Leeuwarden, Netherlands

[21] Appl. No.: 09/051,148

[22] PCT Filed: Oct. 2, 1998

[86] PCT No.: PCT/NL96/00383

§ 371 Date: Apr. 2, 1998

§ 102(e) Date: Apr. 2, 1998

[87] PCT Pub. No.: WO97/12795

PCT Pub. Date: Apr. 10, 1997

[30] Foreign Application Priority Data

Oct. 3, 1998 [NL] Netherlands ..... 1001332

[51] Int. Cl.[6] ..... B61H 7/00

[52] U.S. Cl. ..... 188/41; 188/165

[58] Field of Search ..... 188/41, 164, 165

[56] References Cited

U.S. PATENT DOCUMENTS 5,018,605 5/1991 Hooghiem et al. ..... 188/165
5,647,458 7/1997 Ven Der Sloot et al. ..... 188/41

FOREIGN PATENT DOCUMENTS 361 582 4/1990 European Pat. Off. .
971 289 1/1959 Germany .

*Primary Examiner*—Robert J. Oberleitner
*Assistant Examiner*—Mariano Sy
*Attorney, Agent, or Firm*—Merchant & Gould P.C.

[57] ABSTRACT

A rail brake device (1) having permanent magnetic energization, comprising a housing (3) of magnetizable material, which housing is mounted for up and down movement and has at least one permanent magnetic element (5) which in an operating position of the rail brake device is magnetically coupled to a rail (2), wherein the magnetic element is fixedly mounted along a first wall of a cavity in the housing; a switching element (16) of magnetizable material, slidable back and forth, is located next to the magnetic element, and a second wall of the cavity comprises two parts separated by a magnetic barrier (11), wherein, in the rest position, the switching element forms a magnetic connection between the magnetic element and a part of the second wall (19) of the cavity which is in direct connection with a side of the magnetic element facing away from the switching element, while in the operating position, the switching element forms a magnetic connection between the permanent magnetic element and another part of the second wall, which part of the second wall is magnetically coupled to a wearing piece (13) of the brake device.

10 Claims, 3 Drawing Sheets

RAIL BRAKE DEVICE HAVING PERMANENT MAGNETIC ENERGIZATION

The invention relates to a rail brake device having permanent magnetic energization, comprising a housing of magnetizable material, which housing is mounted for up and down movement and has at least one permanent magnetic element which in an operating position of the rail brake device is magnetically coupled to a rail above which the rail brake device is located, and which in the rest position of the rail brake device is not magnetically coupled to a rail.

Such rail brake devices are already known, for instance from applicant's European patent 0 361 582. The object of the invention is to provide an improved, reliably operating rail brake device of relatively simple and robust construction. To this end, in accordance with the invention, a rail brake device of the above-described type is characterized in that the permanent magnetic element is fixedly mounted along a first wall of a cavity in the housing; that located in the cavity is a switching element of magnetizable material, which switching element is slidable back and forth, by means of operating means, along the magnetic element and along a second wall of the cavity, located opposite the first wall; that the second wall of the cavity comprises at least two parts separated by a magnetic barrier, wherein, in the rest position of the brake device, the switching element forms a magnetic connection between the permanent magnetic element and a part of the second wall of the cavity which, via magnetic material of the rest of the housing, is in direct connection with a side of the permanent magnetic element facing away from the switching element, while in the operating position of the brake device, the switching element forms a magnetic connection between the permanent magnetic element and another part of the second wall, which part of the second wall is magnetically separated from the rest of the housing, but magnetically coupled to a wearing piece of the brake device, which wearing piece is magnetically coupled, via an air gap and a second wearing piece, to the rest of the housing.

Hereinafter, the invention will be further described with reference to the accompanying drawing of an exemplary embodiment.

Figure 1:
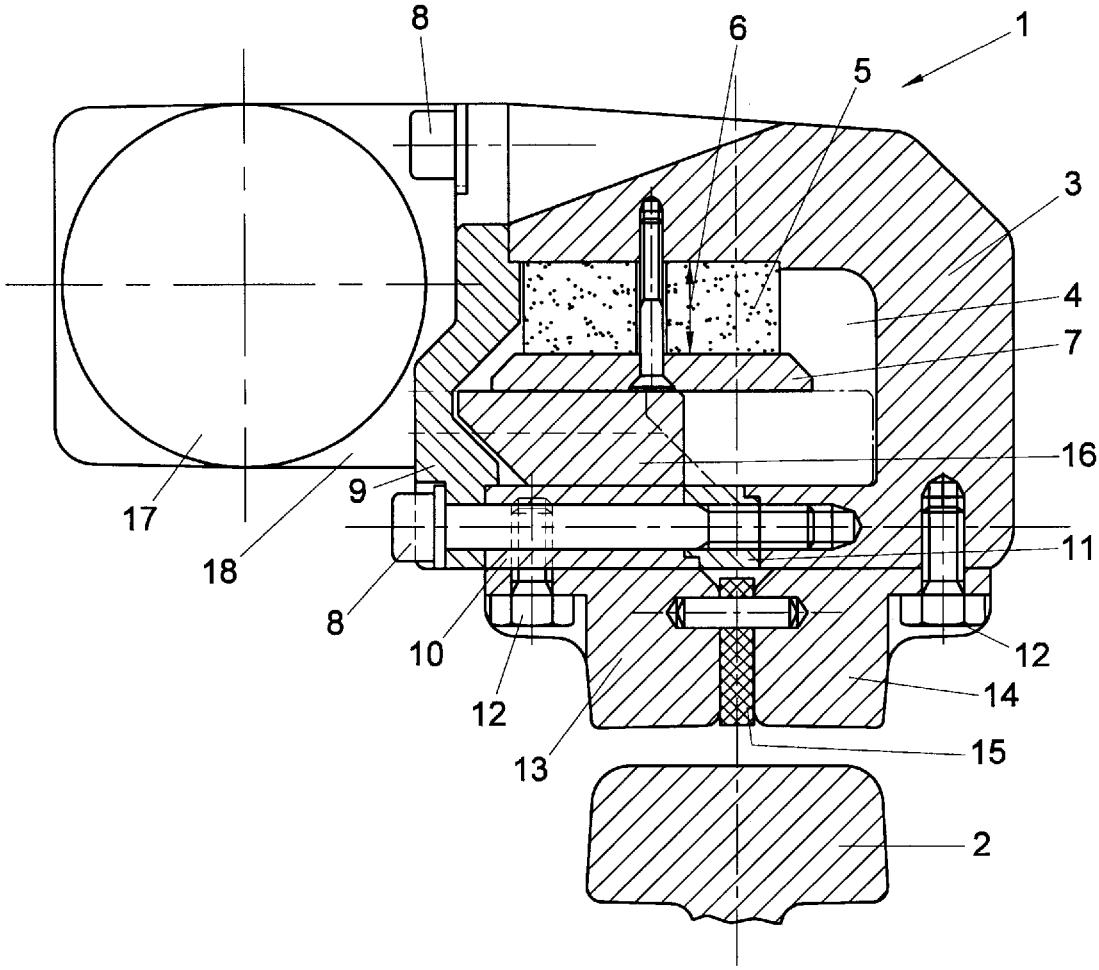
Figure 2:
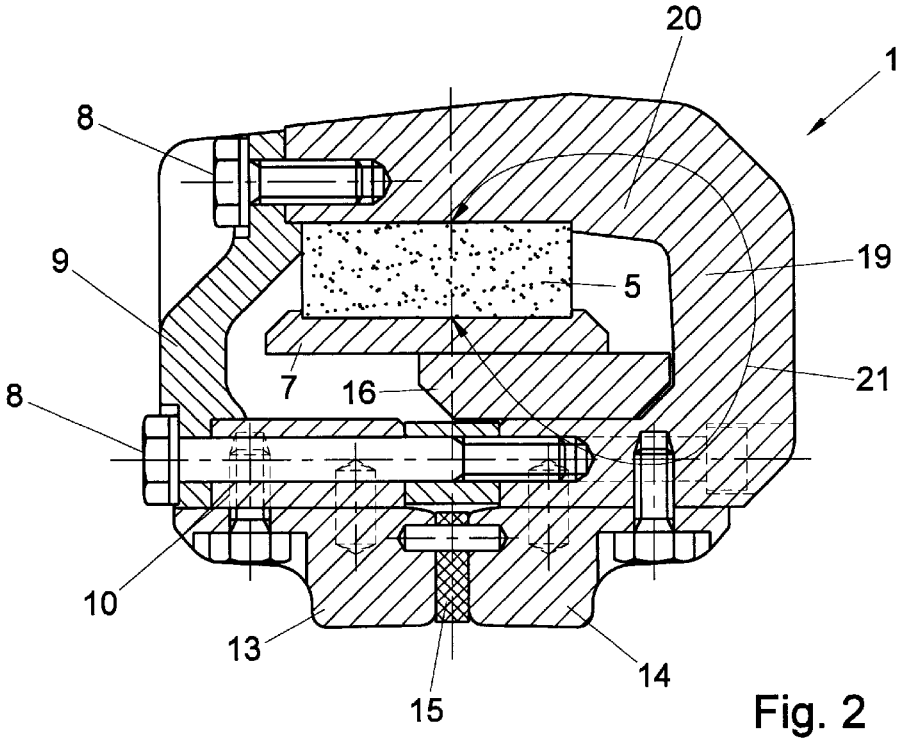
Figure 3:
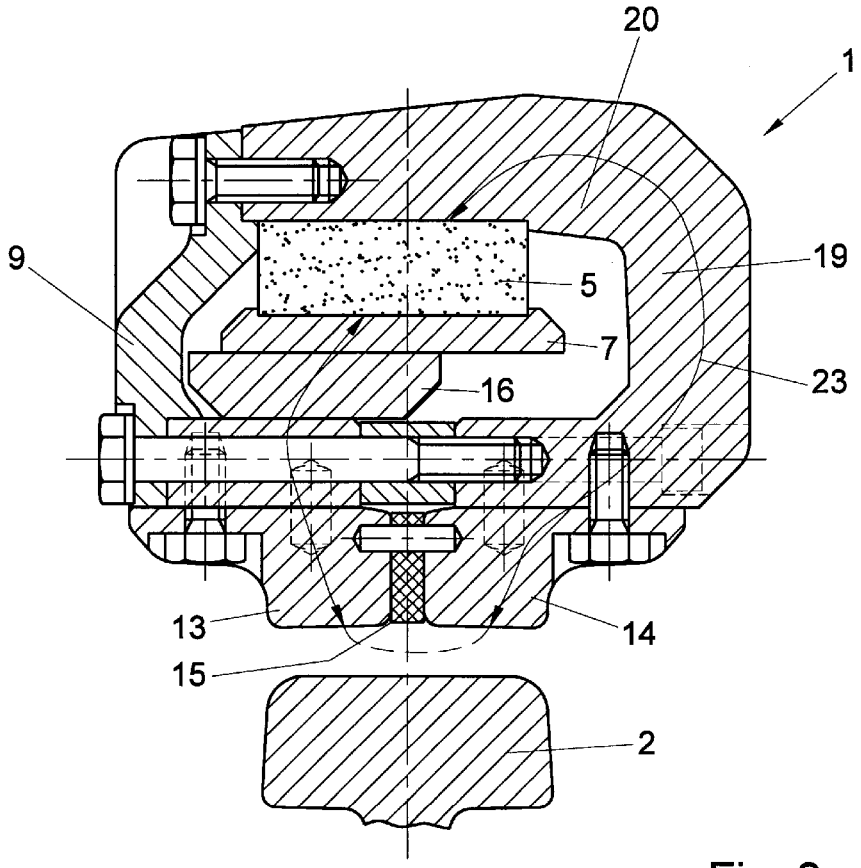
Figure 5:
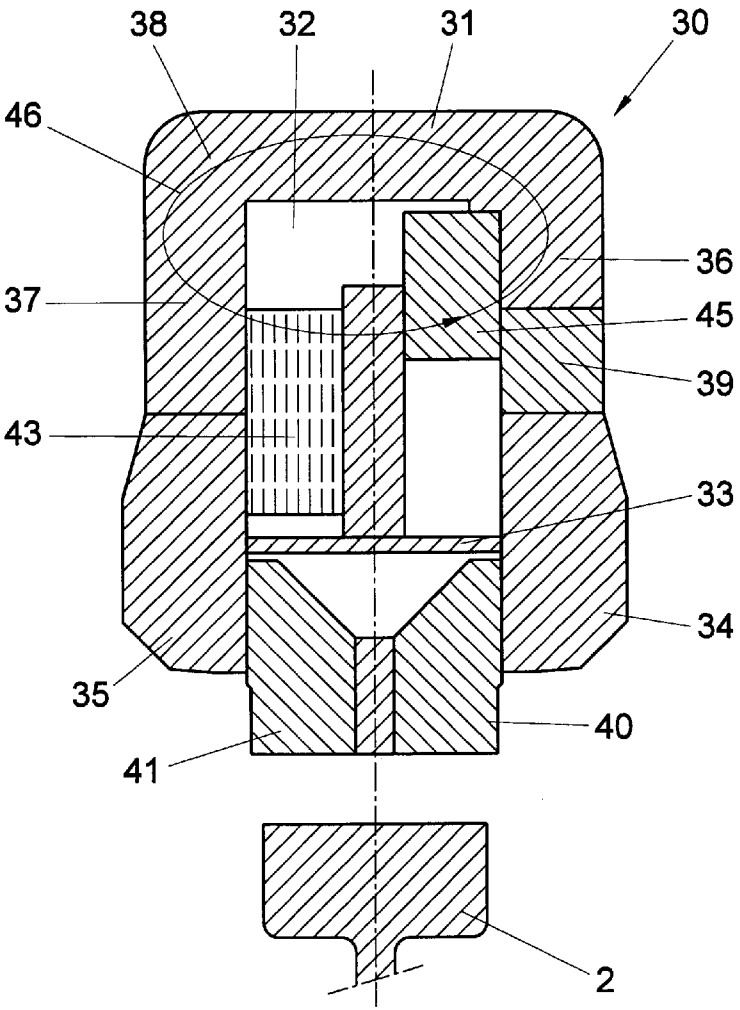
Figure 4:
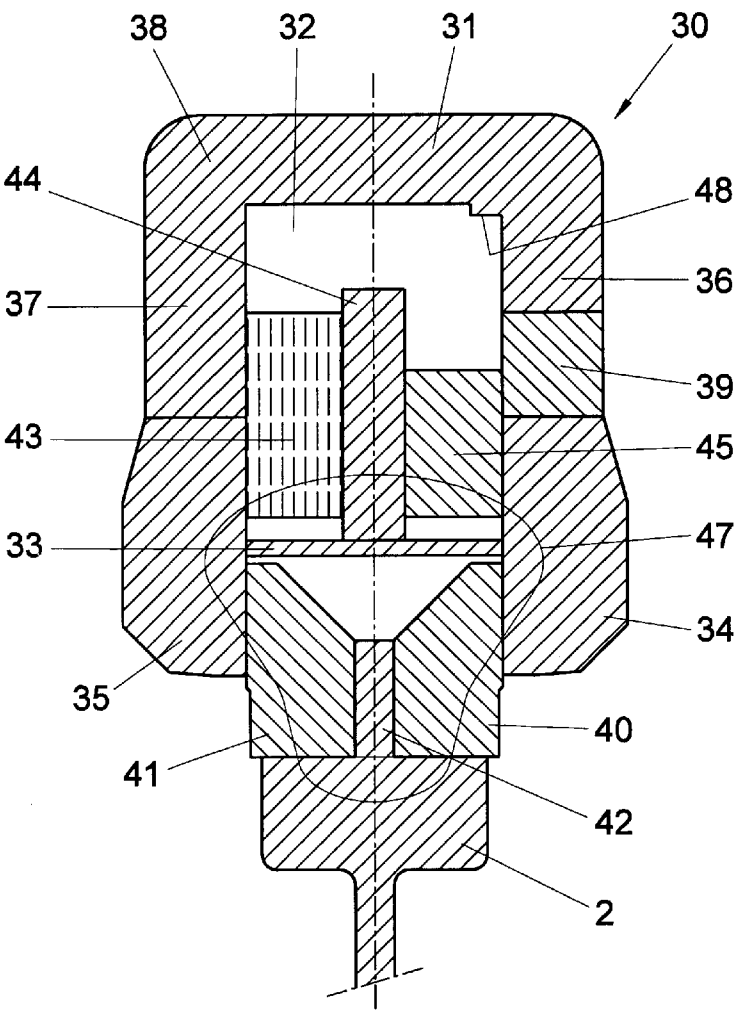

FIG. 1 schematically shows, in cross section, an example of a rail brake device according to the invention;

FIG. 2 schematically shows, in cross section, a part of the device shown in FIG. 1, in the rest position;

FIG. 3 schematically shows, in cross section, a part of the device shown in FIG. 1, in the active position;

FIG. 4 schematically shows a second example of a rail brake device according to the invention, in the active position; and FIG. 5 shows the rail brake device of FIG. 4 in the rest position.

FIG. 1 schematically shows, in a cross section, a rail brake device 1 according to the invention in position above the head of a rail 2. The rail brake device shown is in particular, but not exclusively, suitable for use in a system with low-suspension, wherein the brake shoe in the rest position is suspended fairly close above the rail. The intermediate distance can for instance be 10 mm. Such a brake system can for instance be used in trams, metro trains and the like.

The rail brake device shown comprises a housing 3 of magnetizable material, such as for instance (cast) steel. The housing is formed so as to be about C-shaped and has a cavity 4, wherein, on the top side thereof, a permanent magnet 5 is mounted, magnetized in a substantially vertical direction, as indicated by an arrow 6.

It is observed that in a direction extending transversely to the plane of the drawing, the housing 3 can have a considerable length. The magnet 5 can consist of a number of short sections. The housing, too, could be built up from sections, but preferably consists of one whole, at least in the longitudinal direction, apart from end sections not shown. The magnet is at its bottom side provided with a pole plate 7 which is attached to the magnet in a suitable manner, for instance through glueing, and which is manufactured from magnetizable material, for instance steel.

At the open side, the housing 3 is covered by a cover 9 of non-magnetizable material, for instance aluminum or stainless steel, mounted by means of bolts 8 or the like.

The bottom leg of the C-form of the housing is relatively short, but is extended by means of a lower plate 10 of magnetizable material, for instance steel. The lower plate is attached to the short leg of the housing with the interposition of an intermediate strip 11 of non-magnetizable material, such as aluminum, stainless steel, messing, plastic or the like. For this purpose, the same bolts 8 can be used as those with which the cover is mounted, if so desired.

Mounted on the bottom side of housing 3 by means of bolts 12 or the like is at least one pair of wearing pieces 13,14, forming the brake shoe proper. Each pair of wearing pieces comprises a left and right wearing piece, separated by an air gap filled with a filling piece 15 of non-magnetizable material. In operation, the filling piece lies substantially above the center of the rail with which the brake device should cooperate.

The housing further comprises, in the cavity 4, a switching element 16, in this example beam-shaped, which is located under the pole plate 7 of the magnet 5 and has a width smaller than that of the cavity 4. Viewed in the drawing, the switching element can be slid in an approximately horizontal plane from the left to the right and the other way round. The switching element is made of magnetizable material, for instance steel, and fits precisely between the bottom side of the pole plate 7 and the top side of the bottom leg of the housing and the lower plate 10 respectively. Hence, the switching element in each case forms a magnetic coupling between the pole plate and either the lower plate or the bottom leg of the housing.

In FIG. 1, the switching element is drawn in the leftmost position. In that position, the element lies entirely above the lower plate 10. In FIG. 1, the rightmost position is shown in broken lines, in which position the switching element lies almost entirely above the bottom leg of the C-shaped housing.

Operating means are present for sliding the switching element, which operating means can for instance comprise an electromotor 17 which, as schematically indicated by a broken line 18, is coupled to the switching element in a suitable manner. For this purpose, a lever system can for instance be used, optionally provided with drawback springs and the like. It is also possible to use for instance air cylinders or the like.

The operation of the rail brake device shown in FIG. 1 and described hereinabove is schematically shown in FIGS. 2 and 3. FIGS. 2 and 3 show the rail brake device of FIG. 1, but without the operating means for the switching element. In FIG. 2, the switching element is in the right-hand end position. In that position, the magnetic field generated by the permanent magnet 6 closes via the bottom leg of the C-shaped housing, the rear wall 19 of the housing and the top leg 20 of the housing, as indicated by a (field) line 21. The magnetic field does not extend through the wearing pieces and brake device is in the rest position.

In the situation shown in FIG. 3, the switching element is in the left-hand end position. In this position, the magnetic field extends via the lower plate 10 through the left wearing piece 13, because the intermediate strip 11 and the filling piece 15 form a magnetic barrier.

Under the filling piece, the field continues to the second wearing piece 14, as is drawn in broken lines, and, accordingly, also reaches the head of the rail 2, which, in operation, is nearby. The field further closes via the second wearing piece 14, the bottom leg of the housing, the rear wall 19 of the housing and the top leg of the housing, as indicated by a (field) line 23. In this position of the switching element, the brake device, suspended for movement in vertical direction, pulls itself against the rail, enabling the wearing pieces 13,14 to exert the braking action.

When the switching element is brought into the position shown in FIG. 2 again, the brake device no longer pulls itself against the rail, and the brake device is pulled upwards again by means of drawback members, such as springs, not shown.

FIGS. 4 and 5 schematically show another exemplary embodiment of a rail brake device according to the invention, in the active brake position and in the rest position. The operating device for the switching element is not shown in FIGS. 4 and 5. However, this operating device can be constructed in a similar manner as described hereinabove, with an adjustment in view of the direction of movement, rotated through about 90°, of the switching element, which adjustment is within the scope of a skilled person.

The embodiment of a rail brake device 30 shown in FIGS. 4 and 5 has again an approximately C-shaped housing, which, however, has its open side facing downwards, and is hence constructed as an inverted U-shaped housing 31 having a cavity 32. At the bottom side, the cavity is closed by a wall 33 of a suitable non-magnetic material, such as for instance stainless steel, copper, aluminum, plastic, etc. In the example shown, the wall 33 extends between two pole pieces 34, 35 which extend to below the wall and which connect, at the top sides thereof, to the vertical legs 36,37 of the inverted U-shaped housing, which housing further has a top transverse wall 38. The pole piece 35 lies directly against the leg 37, but the pole piece 34 lies against the leg 36 via an intermediate piece 39 of non-magnetizable material forming a magnetic barrier between the leg 36 and the pole piece 34. Located between the pole pieces and below the bottom wall 33 is at least one pair of wearing pieces 40,41 of magnetizable material, separated by an air gap filled with a filling piece 42 of a suitable non-magnetizable material. The wearing pieces and the filling piece constitute the brake shoe proper. If so desired, the wearing pieces can further be provided, on their sides facing the rail 2, with an additional wear-resistant layer or the like.

In the example shown, a permanent magnet 43 is fixedly mounted on the left wall, which magnet, in the example shown as well as in the above-described exemplary embodiment, has a substantially rectangular cross section. At the side facing away from the left wall of the cavity, the permanent magnet is provided with a pole plate 44. Arranged between the pole plate 44 and the right-hand wall of the cavity is a switching element 45 of magnetizable material, which switching element is slidably up and down through means not further shown. In the rest position shown in FIG. 5, the switching element lies against the part of the right-hand wall of the cavity that is located above the intermediate piece 39, and, in this example, partly against the intermediate piece. The field of the permanent magnet is now short-circuited via the top part of the housing, as is schematically indicated by a closed line 46.

However, in the active brake position shown in FIG. 4, the switching element lies between the pole plate 44 and the pole shoe 34, below and partly against the intermediated piece 39. The field of the permanent magnet now extends through both pole shoes 34,35, the wearing pieces 40,41 and the rail 2, as indicated by a closed line 47. When the brake device, in the rest position, is located at a short distance above the rail, the brake can, if the switching element is in the active position, pull itself against the rail against the force of, for instance, a drawback spring or the like. However, it is also possible to effect or support the up and down movement of the brake device through suitable driving means.

FIGS. 4 and 5 further show, in the cavity, a narrow shoulder 48 in the corner between the right-hand wall 36 and the top wall 38 of the housing. This shoulder 48 constitutes a stop for the switching element and reduces the force required for bringing the switching element into the active position. As shown, the shoulder can form an integral part of the housing, or can consist of one or more loose parts mounted in the housing. In the latter case, the stop could also be manufactured at least partly from non-magnetizable material. A similar provision can also be made in the exemplary embodiment of FIGS. 1–3. The embodiment of FIGS. 4 and 5 is of a relatively simple construction, but requires more space in a vertical sense. Depending on the construction of the rail vehicle, a horizontal or a vertical embodiment may be preferred.

It is observed that after the foregoing, various modifications will readily occur to a skilled person. Such modifications are understood to fail within the framework of the invention.

I claim:

1. A rail brake device having permanent magnetic energization, comprising a housing of magnetizable material, which housing is mounted for up and down movement and has at least one permanent magnetic element, which in an operating position of the rail brake device is magnetically coupled to a rail above which the rail brake device is located, and which in the rest position of the rail brake device is not magnetically coupled to the rail, characterized in that the permanent magnetic element is fixedly mounted along a first wall of a cavity in the housing; that located in the cavity is a switching element of magnetizable material, said switching element being slidable back and forth, by means of operating means, along the magnetic element and along a second wall of the cavity, located opposite the first wall; that the second wall of the cavity comprises at least two parts separated by a magnetic barrier, wherein, in the rest position of the brake device, the switching element forms a magnetic connection between the permanent magnetic element and a part of the second wall of the cavity which, via magnetic material of the rest of the housing, is in direct connection with a side of the permanent magnetic element facing away from the switching element, while in the operating position of the brake device, the switching element forms a magnetic connection between the permanent magnetic element and another part of the second wall, which part of the second wall is magnetically separated from the rest of the housing, but magnetically coupled to a wearing piece of the brake device, said wearing piece being magnetically coupled, via an air gap and a second wearing piece, to the rest of the housing.

2. A rail brake device according to claim 1, characterized in that the cavity in the housing extends in the longitudinal direction of the housing, substantially parallel to the rail, and that the switching element is of beam-shaped design and extends in the longitudinal direction of the housing and is slidable transversely to the longitudinal direction, and that the magnetic barrier also extends in the longitudinal direction of the housing.

3. A rail brake device according to claim 1, characterized in that a pole plate is located between the magnetic element and the switching element, said pole plate being mounted on the magnetic element.

4. A rail brake device according to claim 1, characterized in that the operating means are mounted on a cover closing the cavity of the housing.

5. A rail brake device according to claim 1, characterized in that the first and second walls of the cavity form a top wall and a bottom of the cavity, and that the switching element is slidable back and forth in horizontal direction.

6. A rail brake device according to claim 5, characterized in that the magnetic element is mounted on he top wall.

7. A rail brake device according to claim 1, characterized in that the first and second walls form substantially vertical sidewalls of the cavity, and that the switching element is slidable up and down in substantially vertical direction.

8. A rail brake device according to claim 1, characterized in that in the cavity, a stop is provided for the switching element if said switching element is in the rest position.

9. A rail brake device according to claim 8, characterized in that the stop is an integral part of the housing.

10. A rail brake device according to claim 8, characterized in that the stop at least partly consists of non-magnetizable material.

* * * * *